US010667037B2

(12) United States Patent
Fukuma

(10) Patent No.: US 10,667,037 B2
(45) Date of Patent: May 26, 2020

(54) SPEAKER DEVICE

(71) Applicant: SONY CORPORATION, Tokyo (JP)

(72) Inventor: Yohei Fukuma, Chiba (JP)

(73) Assignee: Sony Corporation, Toyko (JP)

( * ) Notice: Subject to any disclaimer, the term of this patent is extended or adjusted under 35 U.S.C. 154(b) by 0 days.

(21) Appl. No.: 16/098,711

(22) PCT Filed: Jun. 13, 2017

(86) PCT No.: PCT/JP2017/021815
§ 371 (c)(1),
(2) Date: Nov. 2, 2018

(87) PCT Pub. No.: WO2018/012181
PCT Pub. Date: Jan. 18, 2018

(65) Prior Publication Data

US 2019/0141434 A1 May 9, 2019

(30) Foreign Application Priority Data

Jul. 14, 2016 (JP) ..... 2016-139625

(51) Int. Cl.
*H04R 1/24* (2006.01)
*H04R 1/02* (2006.01)
(Continued)

(52) U.S. Cl.
CPC ..... *H04R 1/24* (2013.01); *F21V 33/00* (2013.01); *H04R 1/02* (2013.01); *H04R 1/40* (2013.01);
(Continued)

(58) Field of Classification Search
CPC ... H04R 1/02; H04R 1/24; H04R 1/28; H04R 1/40; H04R 7/12; H04R 17/00; F21V 33/00
(Continued)

(56) References Cited

U.S. PATENT DOCUMENTS 4,989,254 A * 1/1991 Amalaha ..... H04R 1/345 381/182
2007/0133837 A1* 6/2007 Suzuki ..... H04R 1/26 381/396
(Continued)

FOREIGN PATENT DOCUMENTS

JP H11-266496 9/1999
JP 2007-228557 9/2007
(Continued)

OTHER PUBLICATIONS

International Search Report prepared by the Japan Patent Office dated Jul. 20, 2017, for International Application No. PCT/JP2017/021815.

*Primary Examiner* — Alexander Krzystan
(74) *Attorney, Agent, or Firm* — Sheridan Ross P.C.

(57) ABSTRACT

A speaker device is provided, the speaker device ensuring a simplified structure and enhancing the positional precision of a vibrator to an actuator, thereby improving sound quality. The speaker device includes an actuator that operates according to a driving signal, a spring holder having a coupling portion to which the actuator is coupled, the spring holder at least being partially elastically deformable, and a plurality of vibrators connected together via the spring holder, the vibrators vibrating according to the operation of the actuator. In this configuration, the plurality of vibrators are connected together via the spring holder and the actuator is coupled to the coupling portion of the spring holder. Connection of the plurality of vibrators as well as coupling of the actuator, therefore, is achieved by the spring holder. This enhances the positional precision of the vibrators to the actuator.

14 Claims, 9 Drawing Sheets

(51) Int. Cl.

| | |
|---|---|
| ***F21V 33/00*** | (2006.01) |
| ***H04R 7/12*** | (2006.01) |
| ***H04R 17/00*** | (2006.01) |
| ***H04R 1/40*** | (2006.01) |
| *H04R 1/28* | (2006.01) |

(52) U.S. Cl.
CPC ..... *H04R 7/12* (2013.01); *H04R 17/00* (2013.01); *H04R 1/28* (2013.01)

(58) Field of Classification Search
USPC ..... 381/162, 390, 394, 395, 398
See application file for complete search history.

(56) References Cited

U.S. PATENT DOCUMENTS

| | | | | |
|---|---|---|---|---|
| 2007/0160246 | A1* | 7/2007 | Vollmer ..... | H04R 1/323 381/336 |
| 2007/0223734 | A1 | 9/2007 | Suzuki et al. | |
| 2013/0028458 | A1* | 1/2013 | Suzuki ..... | H04R 1/2834 381/338 |
| 2017/0105072 | A1 | 4/2017 | Katsumata | |

FOREIGN PATENT DOCUMENTS

| | | |
|---|---|---|
| JP | 2009-141924 | 6/2009 |
| JP | 2016-012777 | 2/2016 |

* cited by examiner

SPEAKER DEVICE

CROSS REFERENCE TO RELATED APPLICATIONS

This application is a national stage application under 35 U.S.C. 371 and claims the benefit of PCT Application No. PCT/JP2017/021815 having an international filing date of 13 Jun. 2017, which designated the United States, which PCT application claimed the benefit of Japanese Patent Application No. 2016-139625 filed 14 Jul. 2016, the entire disclosures of each of which are incorporated herein by reference.

TECHNICAL FIELD

The present technology relates to a technical field concerning a speaker device that vibrates a vibrator by an actuator that operates according to a driving signal, thereby outputs a sound.

BACKGROUND ART

A speaker device that outputs a sound (voice) with a predetermined frequency band is known. Among such speaker devices, some speaker devices have a configuration in which an actuator is provided with, for example, a vibrating element, such as a piezoelectric element and a magnetostrictive element, and the expansion and contraction of the vibrating element causes a vibrator, such as a vibrating plate, to vibrate to output a sound (see, for example, Patent Document 1).

According to the speaker device described in Patent Document 1, a driving signal is input to the vibrating element to cause it to expand and contract, and the expansion and contraction of the vibrating element causes the vibrator to vibrate to output a sound.

Such a speaker device is able to offer a large driving force, and is therefore able to ensure a fine sound output state.

CITATION LIST

Patent Document

Patent Document 1: Japanese Patent Application Laid-Open No. 11-266496

SUMMARY OF THE INVENTION

Problems to be Solved by the Invention

Now, in the speaker device, when the positional precision of the vibrator to the actuator is low, the efficiency of transmission of vibrations from the actuator to the vibrator becomes low when the driving signal is input to the actuator. This results in a drop in acoustic conversion efficiency, and may lead to lower sound quality.

However, trying to enhance the positional precision of the vibrator to the actuator by using a dedicated positioning mechanism or the like leads to complication of the structure of the speaker device and to an increase in the number of components, thus leading to an increase in manufacturing costs.

An object of the present technology is to provide a speaker device that, in order to solve the above problem, ensures a simplified structure and enhances the positional precision of a vibrator to an actuator, thereby improves sound quality.

Solutions to Problems

First, a speaker device according to the present technology includes an actuator that operates according to a driving signal; a spring holder having a coupling portion to which the actuator is coupled, the spring holder at least being partially elastically deformable; and a plurality of vibrators connected together via the spring holder, the vibrators vibrating according to the operation of the actuator.

In this configuration, the plurality of vibrators are connected together via the spring holder, and the actuator is coupled to the coupling portion of the spring holder.

Second, according to the above speaker device, it is preferable that the actuator have a vibrating element that expands and contracts according to a driving signal, and that the plurality of vibrators be pressed to the vibrating element as the vibrators are each in a state of being urged by the spring holder in a predetermined direction.

In this configuration, when the vibrating element expands and contracts, the urging force of the spring holder keeps the vibrators in contact with the vibrating element.

Third, according to the above speaker device, it is preferable that the vibrators be provided as two vibrators, and that the two vibrators be located opposite to each other across the vibrating element and be put in a state of being in contact respectively with both ends of the vibrating element in the direction of its expansion and contraction.

In this configuration, when the vibrating element expands and contracts, the urging force of the spring holder keeps the vibrators in contact with the vibrating element on both sides opposite to each other. The vibrating element is thus used as a common element that vibrates both vibrators.

Fourth, according to the above speaker device, it is preferable that the two vibrators be positioned such that their respective end faces are counter to each other, and that a cushion be placed between the end faces.

In this configuration, the cushion is deformed elastically when the vibrators vibrate.

Fifth, according to the above speaker device, it is preferable that the vibrators each have a cylindrical, conical, or substantially hemispherical shape, and that a plurality of the actuators are spaced in the circumferential direction of the vibrators.

In this configuration, the vibration of the vibrators is caused by the operation of the plurality of the actuators spaced in the circumferential direction.

Sixth, according to the above speaker device, it is preferable that the plurality of the actuators be arranged at equal intervals.

In this configuration, the vibration of the vibrators is caused by the operation of the plurality of the actuators spaced in the circumferential direction at equal intervals.

Seventh, according to the above speaker device, it is preferable that the vibrators each have a cylindrical, conical, or semi-spherical shape, that the plurality of actuators are spaced in the circumferential direction of the vibrators, that a plurality of the coupling portions be spaced in the circumferential direction of the vibrators, and that the plurality of actuators and the plurality of the coupling portions be arranged at equal intervals.

In this configuration, the vibration of the vibrators is caused by the operation of the plurality of the actuators spaced in the circumferential direction at equal intervals, and the vibrators are coupled to the coupling portions spaced in the circumferential direction at equal intervals.

Eighth, according to the above speaker device, it is preferable that the vibrators be provided as two vibrators, that the spring holder have an annular first holding portion and an annular second holding portion, the first and second holding portions connecting the two vibrators together, and that the first holding portion be located inside the second holding portion.

In this configuration, the first holding portion is not located outside the second holding portion. This reduces the outline of the spring holder.

Ninth, according to the above speaker device, it is preferable that the coupling portions be formed on the second holding portion.

In this configuration, the coupling portions are formed as a part of the second holding portion having a function of holding the vibrators. This eliminates the need of providing the spring holder with a dedicated portion that functions as the coupling portion, thus reducing the outline of the spring holder.

Tenth, according to the above speaker device, it is preferable that a placement space be formed inside the plurality of vibrators, and that the spring holder and the actuators be placed in the placement space.

In this configuration, the vibrators serve as a housing. This eliminates the need of providing a dedicated housing in which the spring holder and the actuators are housed.

Eleventh, according to the above speaker device, it is preferable that a structure unit having a control board that controls at least the actuators be provided, and that the structure unit be placed in the placement space.

In this configuration, the structure unit is placed inside the vibrators functioning also as the housing.

Twelfth, according to the above speaker device, it is preferable that the structure unit has a speaker unit that outputs a sound different from a sound output on the basis of the vibration of the vibrators.

In this configuration, the speaker device outputs a plurality of different sounds.

Thirteenth, according to the above speaker device, it is preferable that a plurality of the control boards be provided, that the structure unit have a speaker unit that outputs a sound different from a sound output on the basis of the vibration of the vibrators, and that the plurality of control boards be arranged along the periphery of the speaker unit.

In this configuration, the speaker unit is located inside the control boards.

Fourteenth, according to the above speaker device, it is preferable that a lighting unit be placed in the placement space.

In this configuration, the speaker device has a lighting function, in addition to the sound output function.

Effects of the Invention

According to the present technology, the plurality of vibrators are connected together via the spring holder and the actuators are coupled to the coupling portions of the spring holder. Connection of the plurality of vibrators as well as coupling of the actuators, therefore, is achieved by the spring holder. This enhances the positional precision of the vibrators to the actuators. As a result, as structural simplification is ensured, the positional precision of the vibrators to the actuators is enhanced to allow an improvement in sound quality.

The effects described in this specification are merely an example. Effects the present technology offers are not limited to this example and may include other effects.

MODE FOR CARRYING OUT THE INVENTION

Figure 1:
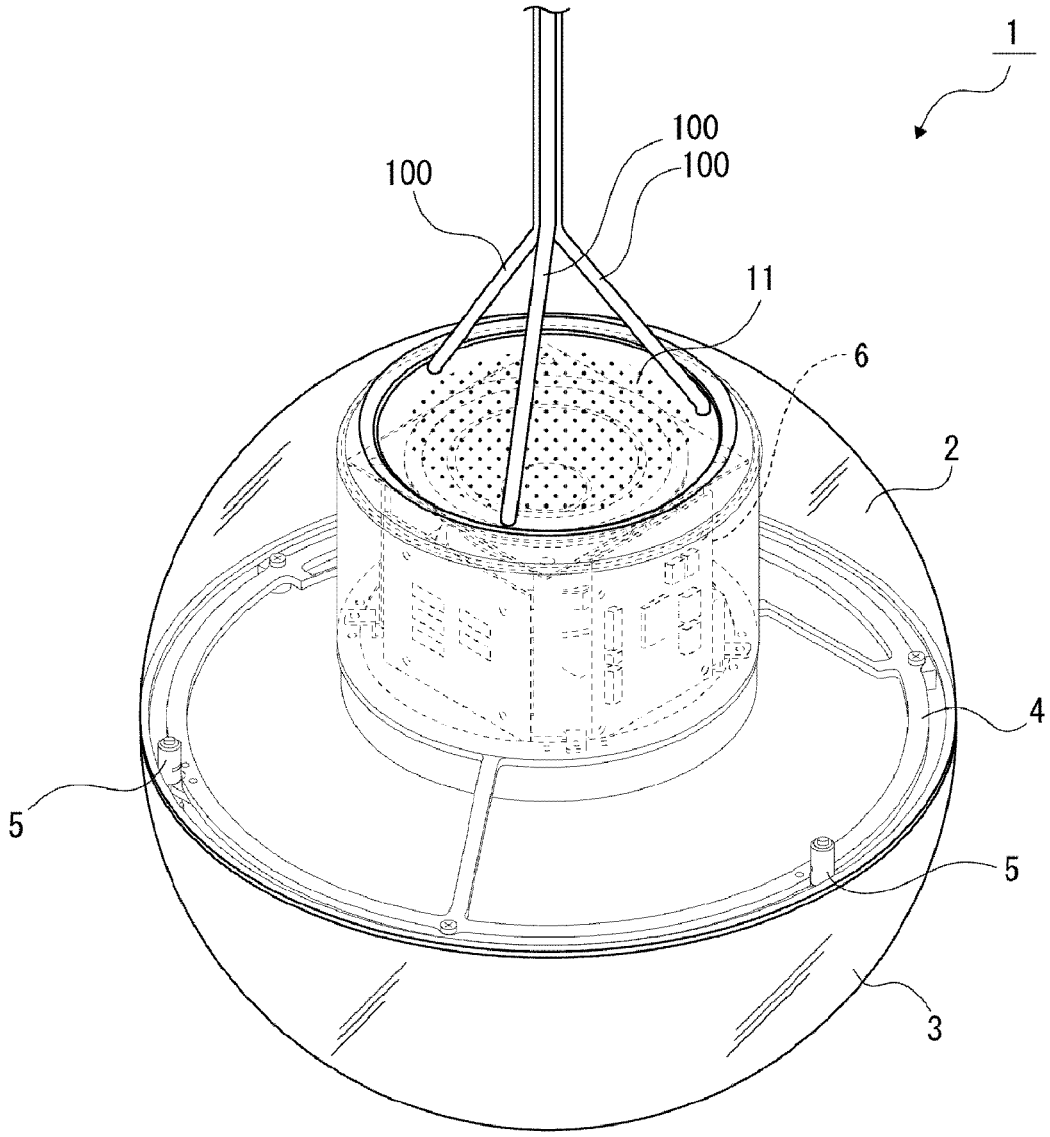
FIG. 1 indicates an embodiment of a speaker device according to the present technology as FIGS. 2 to 13 indicate embodiments of the speaker device, showing a perspective view of the speaker device.

Hereinafter, embodiments of a speaker device according to the present technology will be described with reference to the accompanying drawings.

In the following, a suspended-type speaker device suspended from the ceiling or the like will be described as an example. However, the scope of application of the speaker device according to the present technology is not limited to the suspended-type speaker device. For example, the technology may be widely applied to various speaker devices other than the suspended-type, such as a stationary-type speaker device placed on the floor or the like that serves a bearing surface.

Upper, lower, left, and right directions indicated in the following description are directions defined for facilitating understanding of the description. Under any circumstances, application of the present technology is not limited to these directions.

<Configuration of Speaker Device>

A speaker device 1 includes vibrators 2 and 3 that function also as a housing, a spring holder 4 located inside the vibrators 2 and 3, actuators 5, 5, 5 coupled to the spring holder 4, and a structure unit 6 held by the spring holder 4 (see FIGS. 1 to 4). The speaker device 1 is used in a condition where the speaker device 1 is suspended from the ceiling or the like, using cables 100, 100, 100.

The cables 100 function as a suspending fixture that suspends the speaker device 1. In addition, the cables 100 have wires placed therein such that the wires are connected to predetermined parts of the structure unit 6. The cables 100 thus function also as connection lines for supplying power to the structure unit 6.

The vibrators 2 and 3 are located on the upper side and the lower side, respectively. The vibrator 2 on the upper side is substantially of a hemispherical shape with its upper end portion cut out and lower end open downward. The vibrator 3 on the lower side is substantially of a hemispherical shape with its upper end open upward. The vibrators 2 and 3 are formed using, for example, a transparent resin, such as acryl, as a material of the vibrators 2 and 3.

The vibrator 2 has a lower end surface formed as an annular counter surface 2*a*. The vibrator 2 has pressing portions 7, 7, 7 formed on the inner periphery of the vibrator 2 at locations close to its lower end such that the pressing portions 7, 7, 7 are spaced at equal intervals in the circumferential direction. Each pressing portion 7 has a lower end surface formed as a pressing surface 7*a*. The pressing surface 7*a* is located inside and above the counter surface 2*a* (see FIG. 4). The vibrator 2 has an opening 2*b* formed on the upper end of the vibrator 2 as a cutout vertically penetrating the vibrator 2. Along the edge of the opening 2*b*, a fitting portion 2*c* is formed.

Figure 2:
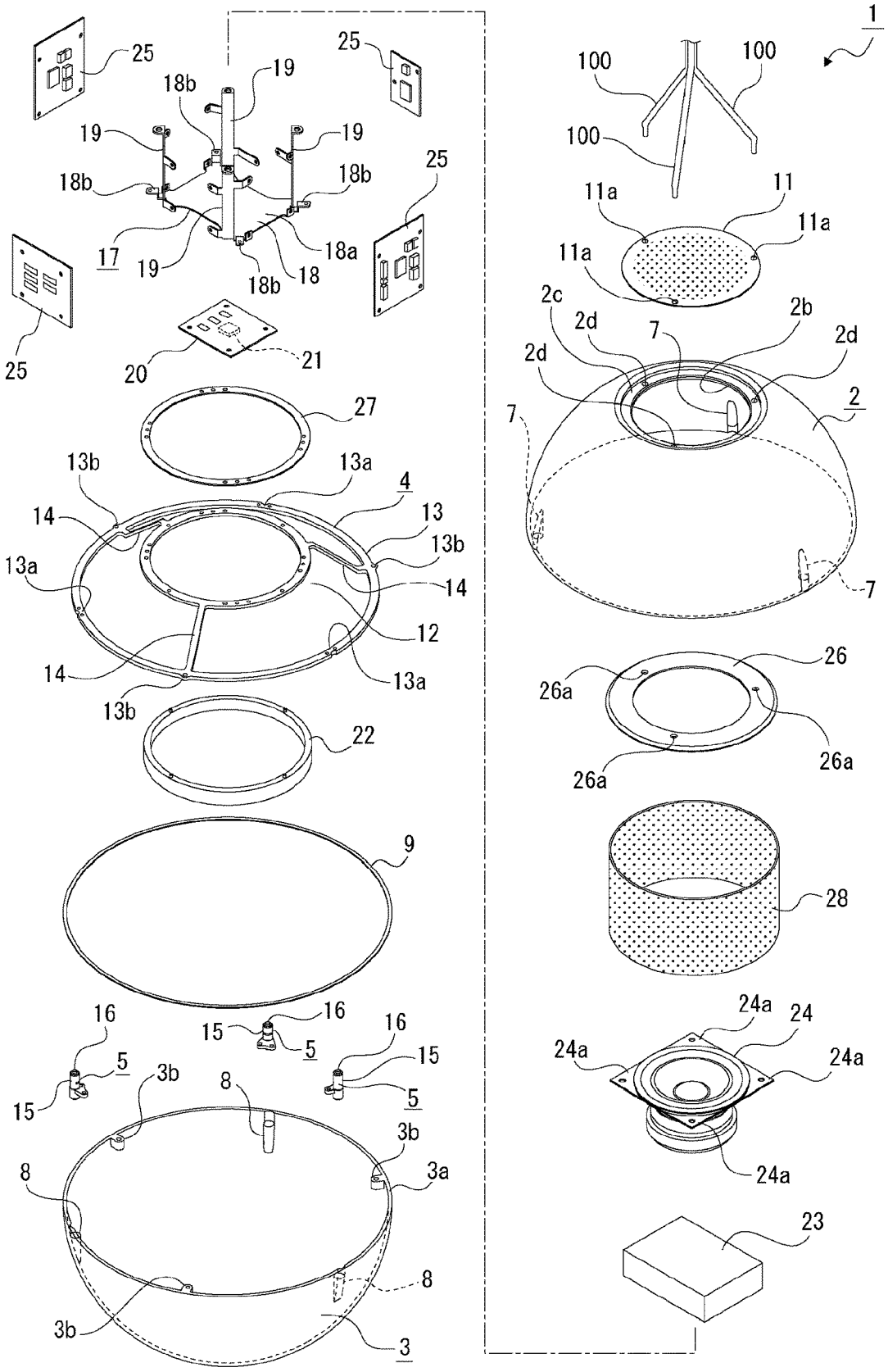
FIG. 2 is an exploded perspective view of the speaker device.
Figure 4:
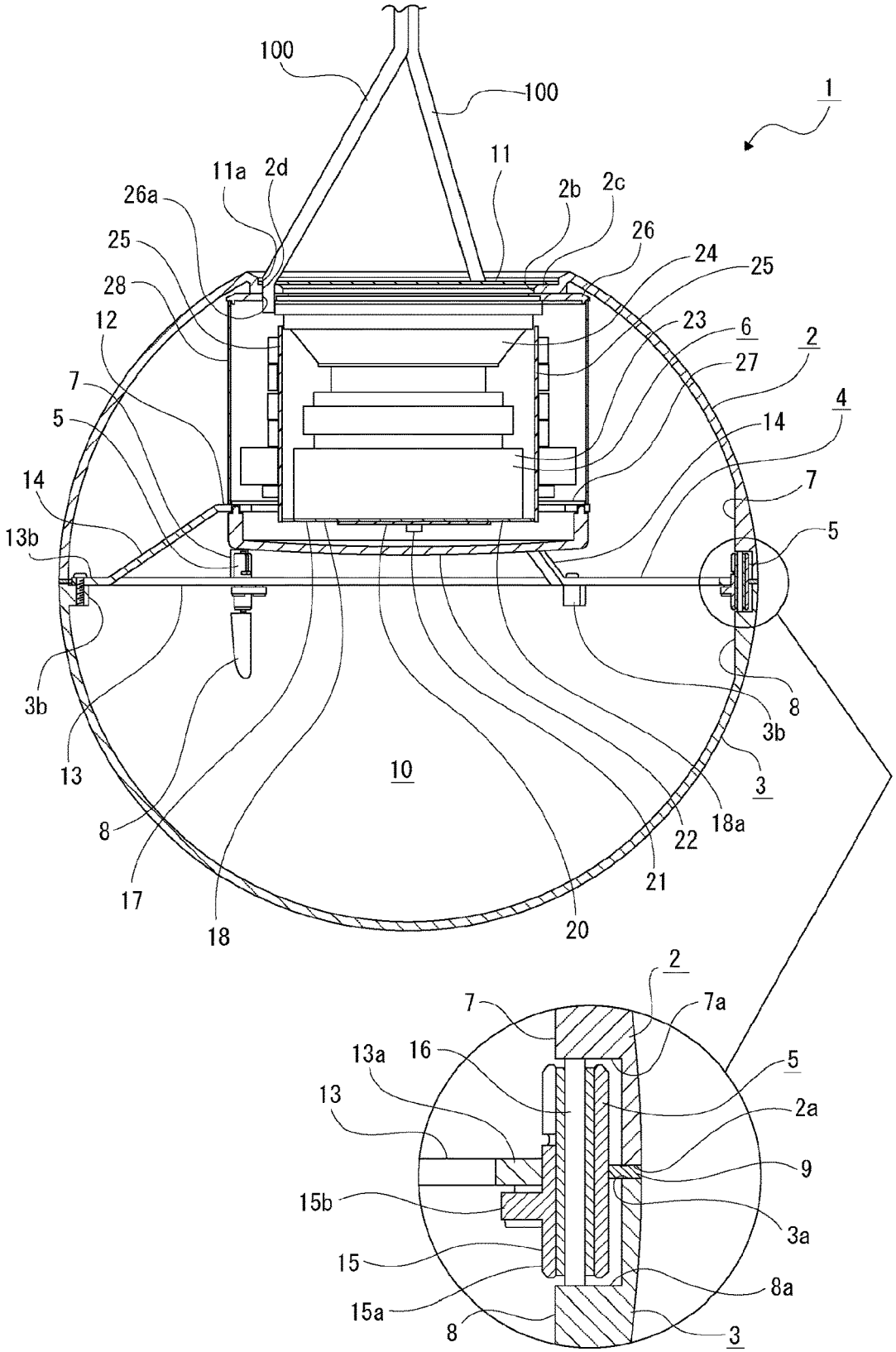
FIG. 4 is a vertical sectional view of the speaker device.

On the upper end of the vibrator 2, cable holes 2*d*, 2*d*, 2*d* are formed in such a way as to be spaced at equal intervals in the circumferential direction (see FIGS. 2 and 4). On the upper end of the vibrator 2, cable cutouts may be formed in place of the cable holes 2*d*.

Figure 3:
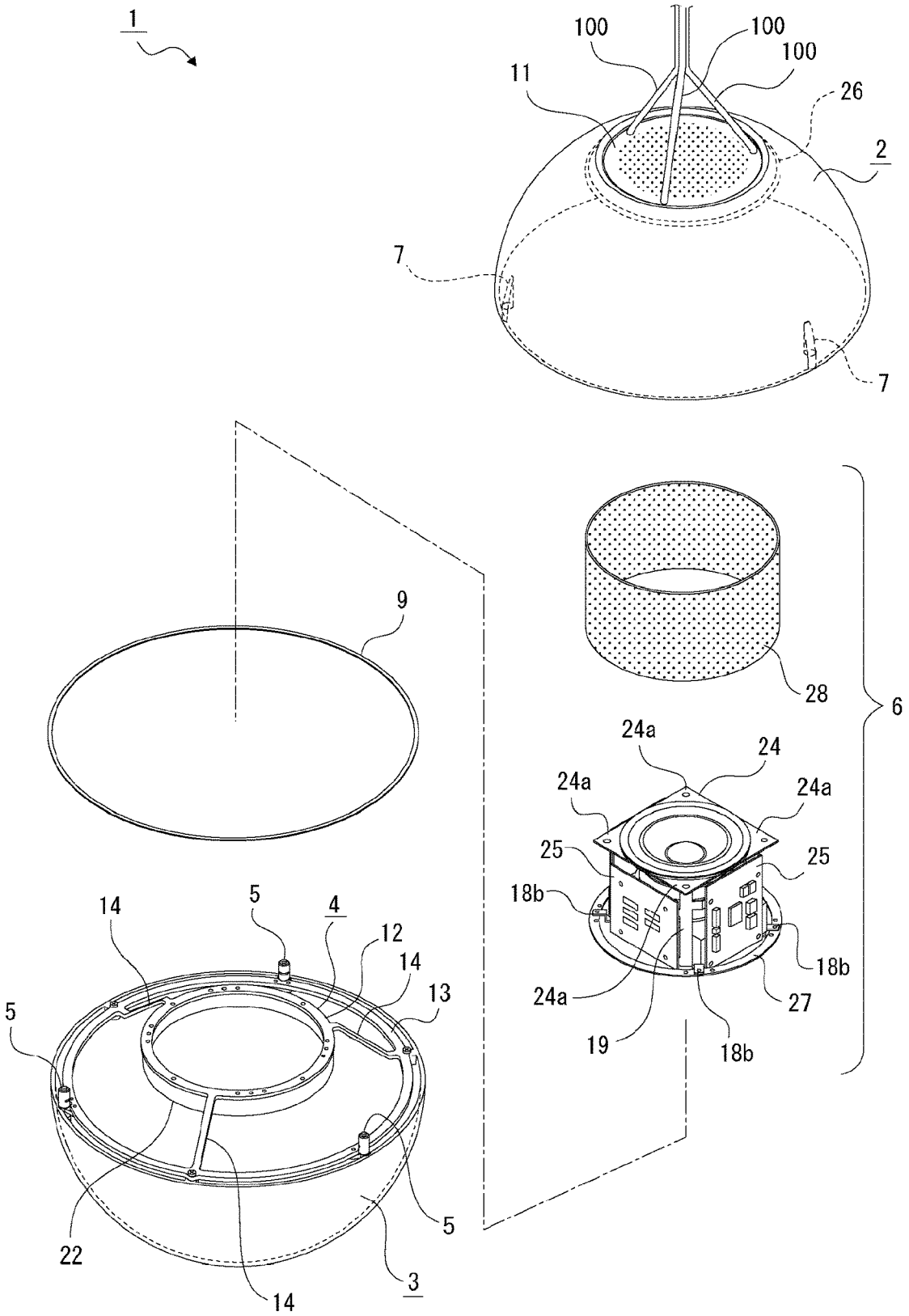
FIG. 3 is a perspective view showing components of the speaker device that are in a disassembled state.

The vibrator 3 has an upper end surface formed as an annular counter surface 3*a* (see FIGS. 2 to 4). The vibrator 3 is provided with fastening portions 3*b*, 3*b*, 3*b* spaced at equal intervals in the circumferential direction. The vibrator 3 has pressing portions 8, 8, 8 formed on the inner periphery of the vibrator 3 at locations close to its upper end such that the pressing portions 8, 8, 8 are spaced at equal intervals in the circumferential direction. Each pressing portion 8 has an upper end surface formed as a pressing surface 8*a*. The pressing surface 8*a* is located inside and above the counter surface 3*a*.

The vibrator 2 and the vibrator 3 are positioned such that the counter surface 2*a* and the counter surface 3*a* are set vertically counter to each other across an annular cushion 9 and that the pressing surfaces 7*a*, 7*a*, 7*a* and the pressing surfaces 8*a*, 8*a*, 8*a* are set vertically counter to each other, respectively. As a material of the cushion 9, for example, a soft material, such as polyurethane foam, is used.

Positioning the vibrators 2 and 3 of substantially hemispherical shapes on the upper and lower sides, respectively, in the above manner creates a substantially spherical space inside the vibrators 2 and 3. This space serves as a placement space 10 (see FIG. 4).

A top cover 11 is attached to the top of the vibrator 2 to close the opening 2*b* with the top cover 11 (see FIGS. 1 to 4). On the outer peripheral part of the top cover 11, insertion holes 11*a*, 11*a*, 11*a* allowing the cables 100, 100, 100 to be inserted therein are formed to be spaced at equal intervals in the circumference direction. The entire part but the outer peripheral part of the top cover 11 is formed as a meshed part. Holes making up the meshed part each serve as a sound-emitting hole.

The spring holder 4 is formed using, for example, a material having proper elasticity and rigidity, such as stainless steel or aluminum, as a material of the spring holder 4. At least part of the spring holder 4 is elastically deformable substantially in the vertical direction. The spring holder 4 includes a ring-shaped first holding portion 12 whose axis extends vertically, a ring-shaped second holding portion 13 whose axis extends vertically as the axis of the first holding portion 12 does, and connecting portions 14, 14, 14 connecting the first holding portion 12 to the second holding portion 13. The first and second holding portions 12 and 13 and the connecting portions 14, 14, 14 are formed integrally to make up the spring holder 4. The spring holder 4 may be formed using, for example, a resin material having proper elasticity and rigidity as a material of the spring holder 4. Examples of such a resin material include polyamide (PA), polyoxymethylene (POM), polycarbonate (PC), polymethylmethacrylate (PMMA), and acrylonitrile-butadiene-styrene resin (ABS).

The axis of the first holding portion 12 and that of the second holding portion 13 are matched. The first holding portion 12 is located above the second holding portion 13 and has a diameter smaller than that of the second holding portion 13.

Figure 5:
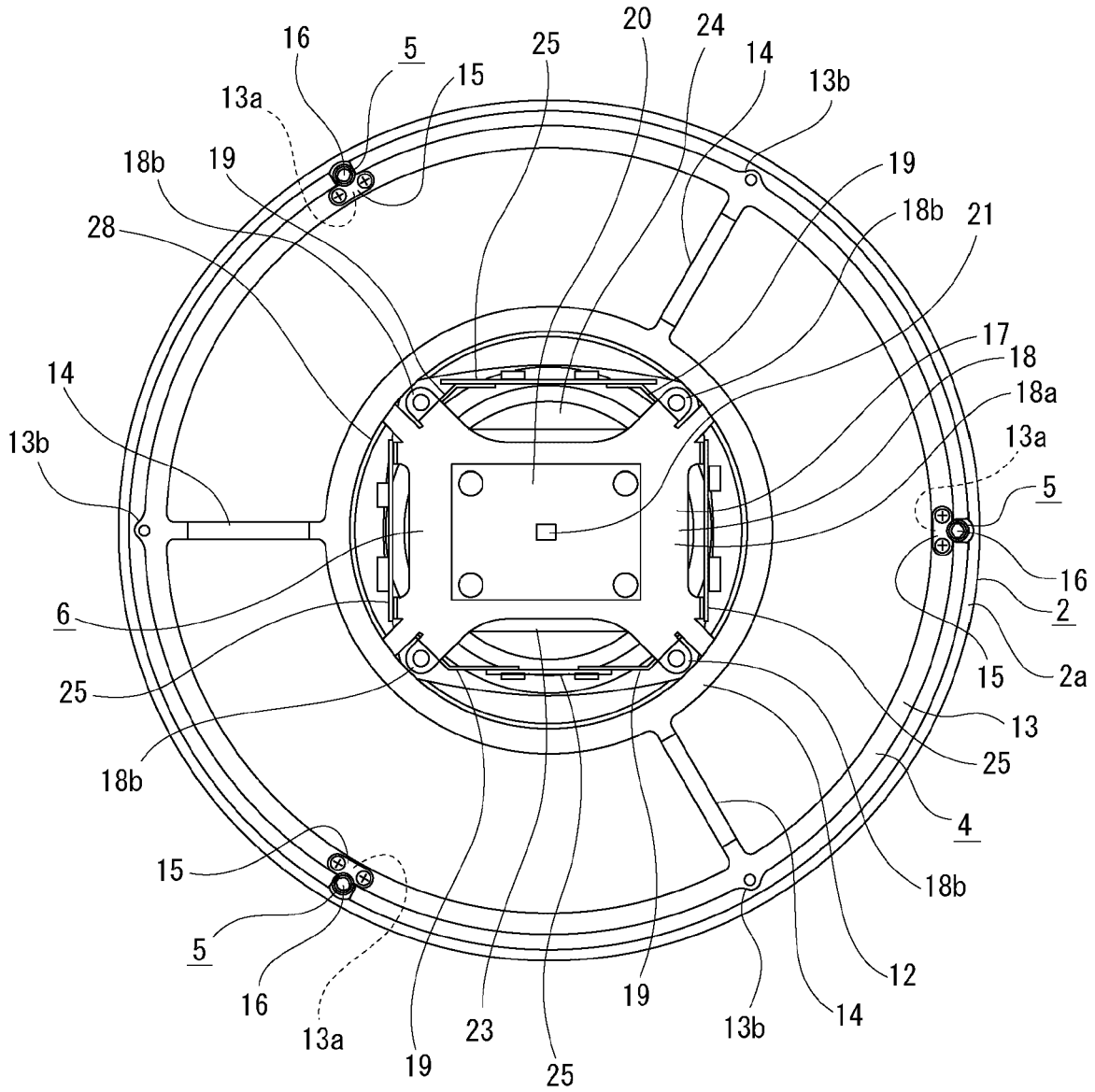
FIG. 5 is a bottom view of the speaker device from which a vibrator on the lower side is removed.

The second holding portion 13 has coupling portions 13*a*, 13*a*, 13*a* spaced at equal intervals in the circumferential direction (see FIG. 5). The second holding portion 13 has fixing portions 13*b*, 13*b*, 13*b* spaced at equal intervals in the circumferential direction. The coupling portions 13*a*, 13*a*, 13*a* and the fixing portions 13*b*, 13*b*, 13*b* are spaced alternately at equal intervals in the circumferential direction.

The connecting portions 14, 14, 14 are spaced at equal intervals in the circumferential direction such that the upper ends of the connecting portions 14, 14, 14 are connected to the first holding portion 12 while the lower ends of the same are connected to the second holding portion 13 (see FIGS. 1 to 4).

The fixing portions 13*b*, 13*b*, 13*b* of the second holding portion 13 of the spring holder 4 are fixed respectively to the fastening portions 3*b*, 3*b*, 3*b* of the vibrator 3, using, for example, screws. The vibrator 3 is, therefore, held by the spring holder 4.

The actuators 5, 5, 5 are fitted respectively to the coupling portions 13*a*, 13*a*, 13*a* of the second holding portion 13. Each actuator 5 has a sleeve 15 and a vibrating element 16.

The sleeve 15 has a cylindrical support cylinder 15*a* whose axis extends vertically, and a coupling projection 15*b* projecting sidewise from the support cylinder 15*a*. The support cylinder 15*a* and the coupling projection 15*b* are formed integrally to make up the sleeve 15.

The vibrating element 16 is, for example, a piezoelectric element of a columnar or prism-like shape, and is supported to be vertically expandable/contractible by the support cylinder 15*a* of the sleeve 15. The vibrating element 16 functions as a vibrating unit that expands and contracts according to an incoming driving signal (voltage signal) and that transmits a force to the vibrators 2 and 3 to cause them to vibrate.

The vibrators 2 and 3 vibrate to output a sound (voice). The vibrators 2 and 3 thus function not only as the housing but also as a sound output unit that outputs a sound. A sound output from the vibrators 2 and 3 is, for example, a sound with a frequency range ranging from a middle frequency range to a high frequency range. The vibrators 2 and 3 thus function as a tweeter.

The vibrating element 16 has upper and lower ends that can be projected upward and downward respectively from the support cylinder 15*a*.

The coupling projections 15*b*, 15*b*, 15*b* of the sleeve 15, 15, 15 are coupled respectively to the coupling portions 13*a*, 13*a*, 13*a* of the second holding portion 13, using, for example, screws. The actuator 5, 5, 5 are therefore held by the spring holder 4.

In the speaker device 1, the coupling portions 13*a*, 13*a*, 13*a* to which the actuators 5, 5, 5 are coupled are formed on the second holding portion 13 of the spring holder 4.

Thus, because the coupling portions 13*a*, 13*a*, 13*a* are formed as a part of the second holding portion 13 having a function of holding the actuators 5, 5, 5, it is unnecessary to provide the spring holder 4 with a dedicated portion that functions as the coupling portions. This reduces the outline of the spring holder 4, thus allowing miniaturization of the speaker device 1 and simplification of its structure.

Furthermore, the spring holder 4 has the annular first holding portion 12 and the annular second holding portion 13 that connect the vibrators 2 and 3 together, and the first holding portion 12 is located inside the second holding portion 13.

Thus, because the first holding portion 12 is not located outside the second holding portion 13, the outline of the spring holder 4 is reduced. This allows further miniaturization of the speaker device 1 and simplification of its structure.

The structure unit 6 is constructed by attaching necessary units to a bracket 17. The bracket 17 has a tabular fitting base 18 of a substantially rectangular shape, and fitting legs 19, 19, . . . projecting upward from the corners of the fitting base 18, respectively.

The fitting base 18 has a fitting surface portion 18*a* facing upward, and connecting projections 18*b*, 18*b*, . . . projecting outward from the corners of the fitting surface portion 18*a*, respectively.

To the lower surface of the fitting surface portion 18*a* of the fitting base 18, a lighting board 20 is fitted. On the lower surface of the lighting board 20, a light source 21 for lighting is mounted. The lighting board 20 is located inside the first holding portion 12. As the light source 21, for example, a light-emitting diode is used.

To the lower surface of the first holding portion 12 of the spring holder 4, a diffuser 22 formed using, for example, a translucent material as a material of the diffuser 22 is fitted in such a way as to cover the lighting board 20. When light is emitted from the light source 21, emitted light passes through the diffuser 22 and the vibrators 2 and 3, especially through the vibrator 3 located on the lower side, to serve as illumination light.

On the top of the fitting base 18, a converter 23 is fitted. The converter 23 is, for example, an AC/DC converter. On the top of the fitting base 18, a battery, such as a lithium ion battery, may be fitted in place of the converter 23.

On the top of the converter 23, a speaker unit 24 is fitted. The speaker unit 24 is provided as, for example, a woofer, and has a function of outputting a sound with a frequency range ranging from a low frequency range to a middle frequency range. On the upper end of the speaker unit 24, fitted portions 24*a*, 24*a*, . . . projecting outward (sidewise) are space in the circumferential direction.

To the bracket 17, for example, four control boards 25, 25, . . . are fitted. The control boards 25, 25, . . . are fitted to the bracket 17 such that the converter 23 and the speaker unit 24 are encircled with the control boards 25, 25, . . . arranged on four sides. As the control boards 25, 25, . . . , for example, communication boards, arithmetic processing boards, sound effect control boards, or audio boards are used. At least one of the control boards 25, the actuators 5, 5, 5, and the speaker unit 24 are connected through connecting lines that are not depicted.

As described above, the speaker device 1 includes the speaker unit 24 that outputs a sound different from a sound output on the basis of the vibration of the vibrators 2 and 3, and the control boards 25, 25, . . . . In the speaker device 1, the control boards 25, 25, . . . are arranged along the periphery of the speaker unit 24.

In this configuration, therefore, the speaker unit 24 is located inside the control boards 25, 25, . . . . This reduces a space occupied by the structure unit 6 in the placement space, and therefore allows miniaturization of the speaker device 1.

The fitted portions 24*a*, 24*a*, . . . of the speaker unit 24 are fitted to the upper ends of the fitting legs 19, 19, . . . of the bracket 17, respectively.

On the upper end of the speaker unit 24, a ring-shaped fitting plate 26 is fitted. The fitting plate 26 has cable insertion holes 26*a*, 26*a*, . . . formed to be spaced in the circumferential direction. The fitting plate 26 is fitted to the fitting portion 2*c* formed on the upper end of the vibrator 2.

On the top of the first holding portion 12 of the spring holder 4, an annular connecting plate 27 is fitted. To the connecting plate 27, the connecting projections 18*b*, 18*b*, . . . of the fitting base 18 of the bracket 17 are fitted. The bracket 17 is, therefore, fitted to the first holding portion 12 via the connecting plate 27, and consequently the structure unit 6 is fitted to the spring holder 4.

To the first holding portion 12 of the spring holder 4 and to the fitting plate 26, a cylindrical grill 28 of a cylindrical shape is fitted. The cylindrical grill 28 is meshed, and has an upper end coupled to the outer periphery of the fitting plate 26 and a lower end coupled to the outer periphery of the first holding portion 12 of the spring holder 4. The cylindrical grill 28 covers the outer peripheries of the control boards 25, 25, . . . , the converter 23, and the speaker unit 24, thus making the control boards, converter, and speaker unit invisible from the outside. Since the cylindrical grill 28 is meshed, it does not hamper the flow of air inside the speaker device 1. The presence of the cylindrical grill 28, therefore, does not hamper the operation of the speaker unit 24.

In a state in which the structure unit 6 is fitted to the spring holder 4, the fitting plate 26 of the structure unit 6 is fitted to the fitting portion 2*c* of the vibrator 2, as described above. Hence, the spring holder 4 connects the vibrator 2 and the vibrator 3 together via the structure unit 6.

In this manner, according to the speaker device 1, the spring holder 4 connects the vibrator 2 and the vibrator 3 together. Because of this configuration, the spring holder 4 capable of elastic deformation applies an urging force to the vibrator 2 and the vibrator 3, the urging force acting in a direction of moving the vibrator 2 and the vibrator 3 closer to each other (i.e., in the vertical direction). As a result, the pressing surfaces 7*a* of the vibrator 2 urged downward by the spring holder 4 are pressed respectively to the upper surfaces of the vibrating elements 16, 16, 16, while the pressing surfaces 8*a* of the vibrator 3 urged upward by the spring holder 4 are pressed respectively to the lower surfaces of the vibrating elements 16, 16, 16.

In a state in which the fitting plate 26 is fitted to the fitting portion 2*c* of the vibrator 2, cables 100, 100, 100 are put through the insertion holes 11*a*, 11*a*, 11*a* of the top cover 11, through the cable holes 2*d*, 2*d*, 2*d* of the vibrator 2, and through the cable insertion holes 26*a*, 26*a*, 26*a* of the fitting plate 26 in order. The cables 100, 100, 100 are connected to the lighting board 20 and to the control boards 25, 25, . . . . Through the cables 100, 100, 100, therefore, power is supplied to the light source 21 mounted on the lighting board 20 and to the control boards 25, 25, . . . . Furthermore, power is supplied also to the vibrating elements 16, 16, 16 of the actuators 5, 5, 5 and to the speaker unit 24 via the control boards 25.

Furthermore, when necessary, a sound signal is also supplied to the control boards 25, 25, . . . and the like. A sound signal is supplied not only by wired means and may be supplied also by wireless means. For example, according to the speaker device 1, an audio signal is input to the speaker device 1 through wired or wireless means, and, on the basis of this input audio signal, a driving signal to be output to the vibrating element 16, 16, 16 is generated.

As described above, according to the speaker device 1, the placement space 10 is formed inside the vibrators 2 and 3, and the spring holder 4 and the actuators 5, 5, 5 are placed in the placement space 10.

The vibrators 2 and 3 thus serve as the housing. This eliminates the need of providing a dedicated housing for housing the spring holder 4 and the actuators 5, 5, 5, thus allowing a reduction in the number of components of the speaker device 1 and miniaturization of the speaker device 1.

Furthermore, the structure unit 6 having the control boards 25, 25, . . . that control at least the actuators 5, 5, 5 is provided and is placed in the placement space 10.

The structure unit 6 is, therefore, placed inside the vibrators 2 and 3 that function also as the housing. As a result, the placement space is used effectively to allow further miniaturization of the speaker device 1.

<Operation of Speaker Device>

In the speaker device 1 configured in the above manner, when a driving signal is input to the vibrating elements 16, 16, 16, the vibrating elements 16, 16, 16 expand and contract vertically according to the incoming driving signal. As a result, the vibrators 2 and 3 pressed to the vibrating elements 16, 16, 16 vibrate. The vibration of the vibrators 2 and 3 produces a sound with a frequency range ranging from a middle frequency range to a high frequency range. At this time, the expanding and contracting vibrating elements 16, 16, 16 cause the vibrators 2 and 3 to slightly move vertically. However, because the actuators 5, 5, 5 are held by the spring holder 4 as the vibrators 2 and 3 in the state of being held by the spring holder 4 are urged in the direction in which the vibrators 2 and 3 move closer to each other, the pressing surfaces 7*a* and the pressing surfaces 8*a* are kept pressed to the upper surfaces of the vibrating elements 16, 16, 16 and the lower surfaces of the same, respectively.

In this manner, the actuators 5 each have the vibrating element 16 that expands and contracts according to a driving signal, and the vibrators 2 and 3 in the state of being urged by the spring holder 4 in the predetermined direction are pressed to the vibrating elements 16 of the actuators 5.

Thus, when the vibrating elements 16 expand and contract, the urging force of the spring holder 4 keeps the vibrators 2 and 3 in contact with the vibrating elements 16. As a result, the driving force of the vibrating elements 16 is transmitted certainly to the vibrators 2 and 3, so that the reliability of the operation of the vibrators 2 and 3 can be improved.

Furthermore, the vibrators 2 and 3 are located opposite to each other across the vibrating elements 16 and are put in a state of being in contact with both ends (upper and lower ends) of the vibrating elements 16 in the direction of their expansion and contraction.

When the vibrating elements 16 expand and contract, therefore, the vibrators 2 and 3 are kept in contact with the vibrating elements 16 on both sides opposite to each other, respectively, by the urging force of the spring holder 4. The vibrating elements 16 are thus used as common elements for vibrating both vibrators 2 and 3. This eliminates the need of dedicated vibrating elements that separately vibrate the vibrators 2 and 3, respectively, thus allowing a reduction in the number of components and miniaturization of the speaker device 1, as well as an improvement in the efficiency of transmission of vibration energy.

Moreover, the counter surface 2*a* of the vibrator 2 and the counter surface 3*a* of the vibrator 3 are located counter to each other, and the cushion 9 is placed between the counter surface 2*a* and the counter surface 3*a*.

Thus, when the vibrators 2 and 3 vibrate, the cushion 9 is elastically deformed to prevent the vibrators 2 and 3 from coming in contact with each other without hampering the vibration of the vibrators 2 and 3. This ensures the stable vibration state of the vibrators 2 and 3. The cushion 9 placed in the above manner fills a gap between the vibrator 2 and the vibrator 3. The cushion 9 functions also as a housing for the speaker unit 24, preventing air from flowing out of the vibrators 2 and 3 when the speaker unit 24 operates. This allows an improvement in sound quality and sound pressure.

Furthermore, the vibrators 2 and 3 are each made into a substantially hemispherical shape, and the plurality of actuators 5, 5, 5 are spaced in the circumferential direction of the vibrators 2 and 3.

Thus, the vibrators 2 and 3 are caused to vibrate by the operation of the plurality of actuators 5, 5, 5 spaced in the circumferential direction. This stabilizes the vibration state of the vibrators 2 and 3, thus allowing an improvement in sound quality.

Because the plurality of actuators 5, 5, 5 are spaced at equal intervals and the vibrators 2 and 3 are caused to vibrate by the operation of these actuators 5, 5, 5 spaced in the circumferential direction at equal intervals, the vibration state of the vibrators 2 and 3 is further stabilized to allow a further improvement in sound quality.

Furthermore, the plurality of actuators 5, 5, 5 as well as the plurality of coupling portions 13*a*, 13*a*, 13*a* of the spring holder 4 are arranged at equal intervals.

Thus, the vibrators 2 and 3 are caused to vibrate by the operation of the plurality of actuators 5, 5, 5 spaced in the circumferential direction at equal intervals as the vibrators 2 and 3 are coupled to the plurality of coupling portions 13*a*, 13*a*, 13*a* spaced in the circumferential direction at equal intervals. This stabilizes the vibration state of the vibrators 2 and 3 and the state of coupling of the vibrators 2 and 3 to the spring holder 4, thus allowing a further improvement in sound quality.

Note that the size or material of the vibrators 2 and 3 may be changed at one's discretion, provided that the vibrators 2 and 3 are configured to generate vibrations as a result of the expansion and contraction of the vibrating elements 16, 16, 16. By changing the size or material of the vibrators 2 and 3, sound frequencies or the direction of sound emission can be adjusted on a necessary basis. As a result, a degree of freedom in designing the speaker device 1 can be improved.

Furthermore, adjusting the urging force applied to the vibrators 2 and 3 of the spring holder 4 also allows adjustment of the frequency or sound pressure of an emitted sound. Likewise, adjusting the urging force applied to the vibrators 2 and 3 of the spring holder 4 also allows an improvement in the degree of freedom in designing the speaker device 1.

Now, when a driving signal is input to the speaker unit 24, the speaker unit 24 outputs a sound with a frequency range ranging from a low frequency range to a middle frequency range. The sound output from the speaker unit 24 travels through the sound-emitting holes of the top cover 11 to the outside.

In this manner, the speaker device 1 includes the speaker unit 24 that outputs a sound different from a sound output on the basis of the vibration of the vibrators 2 and 3. The speaker device 1 thus outputs a plurality of different sounds. This leads to an improvement in the functionality of the speaker device 1 and expansion of the sound range of the speaker device 1.

When power is supplied to the light source 21 via the lighting board 20, the light source 21 emits light, and the emitted light passes through the translucent diffuser 22 and the transparent vibrators 2 and 3 to the outside, where the emitted light serves as illuminating light.

In this manner, according to the speaker device 1, the light source 21 functioning as a lighting unit is placed in the placement space 10. The speaker device 1 thus has a lighting function, in addition to the sound output function, and therefore offers improved functionality.

Other Configuration Examples

Figure 6:
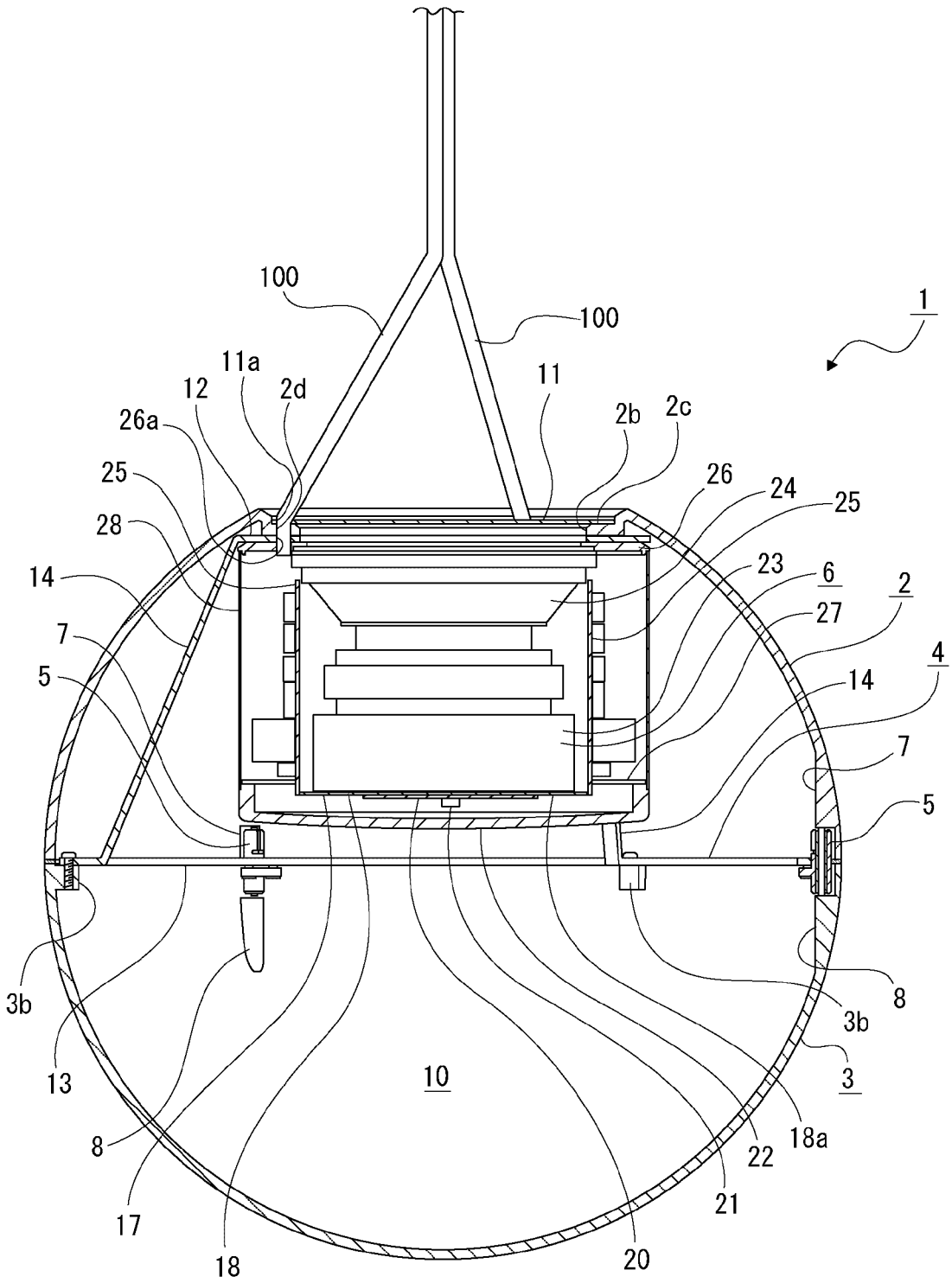
FIG. 6 is a vertical sectional view showing another configuration of the speaker device.

The configuration in which the vibrator 2 and the vibrator 3 are connected together by the spring holder 4 via the structure unit 6 has been described above. Another configuration in which, for example, the first holding portion 12 of the spring holder 4 is fitted to the fitting portion 2*c* of the vibrator 2 as the structure unit 6 is fitted to the lower surface of the first holding portion 12 may also be adopted (see FIG. 6).

In this configuration, the vibrator 2 and the vibrator 3 are connected together by the spring holder 4 without interposing the structure unit 6 between the vibrator 2 and the vibrator 3. Regardless of the degree of strength of the structure unit 6, therefore, the vibrator 2 and the vibrator 3 can be connected together in a stable state by the spring holder 4.

SUMMARY

As described above, the speaker device 1 includes the actuators 5 that operate according to a driving signal, the spring holder 4 having the coupling portions 13*a* to which the actuators 5 are coupled, the spring holder 4 at least being partially elastically deformable, and the vibrators 2 and 3 connected together via the spring holder 4, the vibrators 2 and 3 vibrating according to the operation of the actuators 5.

Thus, the vibrators 2 and 3 are connected together via the spring holder 4 and the actuators 5 are coupled to the coupling portions 13*a* of the spring holder 4. Connection of the vibrators 2 and 3 as well as coupling of the actuators 5, therefore, is achieved by the spring holder 4. This enhances the positional precision of the vibrators 2 and 3 to the actuators 5. As a result, as structural simplification is ensured, the positional precision of the vibrators 2 and 3 to the actuators 5 is enhanced to allow an improvement in sound quality.

Furthermore, the speaker device 1 can be constructed by attaching the spring holder 4 having the actuators 5, 5, 5 fitted thereto, from above to the vibrator 3, attaching the structure unit 6 from above to the first holding portion 12 of the spring holder 4, attaching the vibrator 2 from above to the structure unit 6 as the cushion 9 is fitted on the vibrator 3, and attaching the top cover 11 from above to the vibrator 2 in sequence.

The speaker device 1, therefore, can be constructed by attaching each component to a different component or the like in one direction in sequential assembling procedures. This improves the assembling efficiency of the speaker device 1, thus allowing a reduction in manufacturing time and manufacturing cost.

<Others>

An example of the speaker device 1 including the vibrators 2 and 3 each having a substantially hemispherical shape is described above. The vibrators of the speaker device 1, however, may be made into any given shape.

Figure 7:
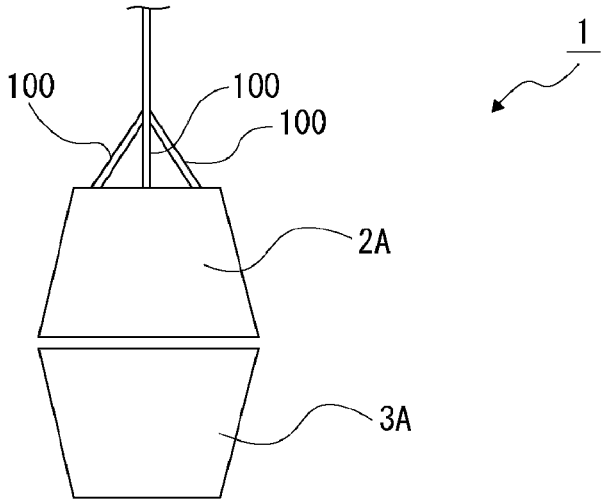
FIG. 7 is a side view of vibrators in an example in which the vibrators each have a truncated cone shape.
Figure 8:
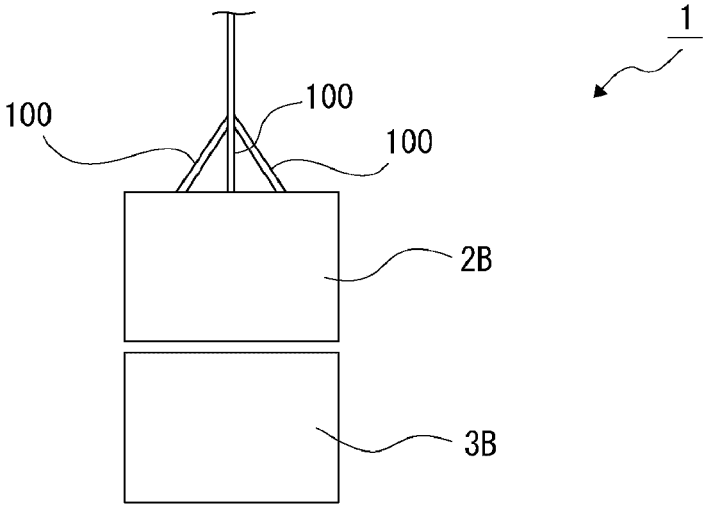
FIG. 8 is a side view of vibrators in an example in which the vibrators each have a cylindrical shape.

The speaker device 1 may include, for example, vibrators 2A and 3A each having a truncated cone shape (see FIG. 7), and may include, for example, vibrators 2B and 3B each having a cylindrical shape (see FIG. 8). In the speaker device 1, the shape of the vibrators is not limited to a truncated cone shape, and may be a conical shape or a polygonal pyramid shape, such as a trigonal pyramid shape.

Figure 9:
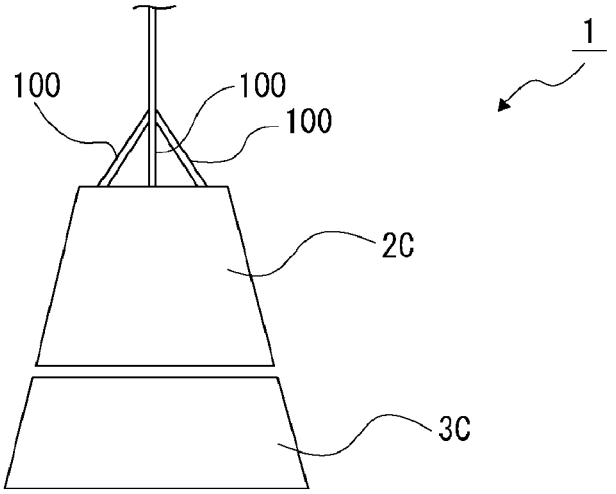
FIG. 9 is a side view of vibrators in another example in which the vibrators each have a truncated cone shape.
Figure 10:
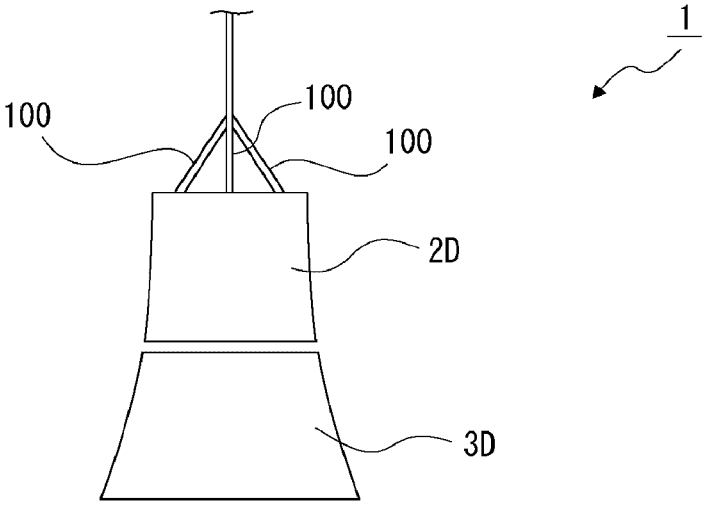
FIG. 10 is a side view of vibrators in an example in which the vibrators each have a curved outer peripheral surface.

Furthermore, the speaker device 1 may include, for example, vibrators 2C and 3C each having a truncated cone shape whose diameter increases as the shape extends upward or downward (see FIG. 9), and may include, for example, vibrators 2D and 3D each having a curved outer peripheral surface so that the diameter of the vibrator increases as the vibrator extends upward or downward (see FIG. 10). The outer peripheral surface of each of the vibrators 2D and 3D is formed as, for example, tracks of parabolas rotated at 360 degrees.

Figure 11:
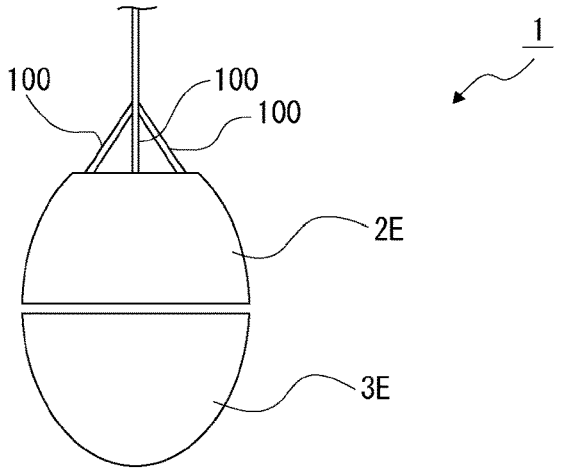
FIG. 11 is a side view of vibrators in an example in which the vibrators each have a substantially ellipsoidal shape.
Figure 12:
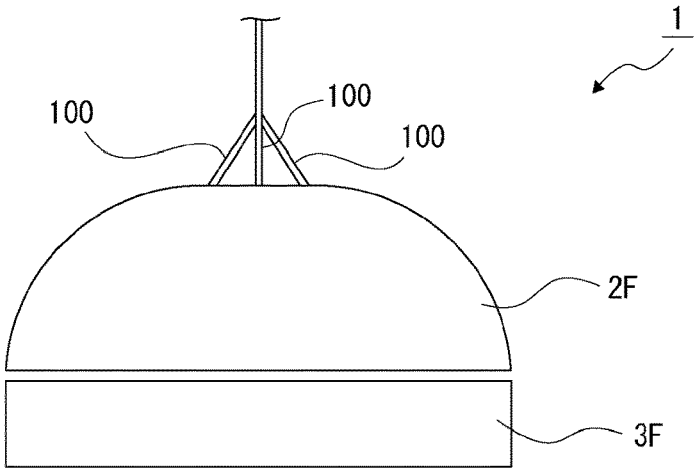
FIG. 12 is a side view of vibrators in an example in which the vibrators are a combination of a substantially hemispherical shape and a cylindrical shape.

Moreover, the speaker device 1 may include vibrators 2E and 3E each having a rugby-ball-like shape or ellipsoidal shape with a cut out part (see FIG. 11) or may include, for example, a combination of a substantially hemispherical vibrator 2F and a cylindrical vibrator 3F (see FIG. 12).

Figure 13:
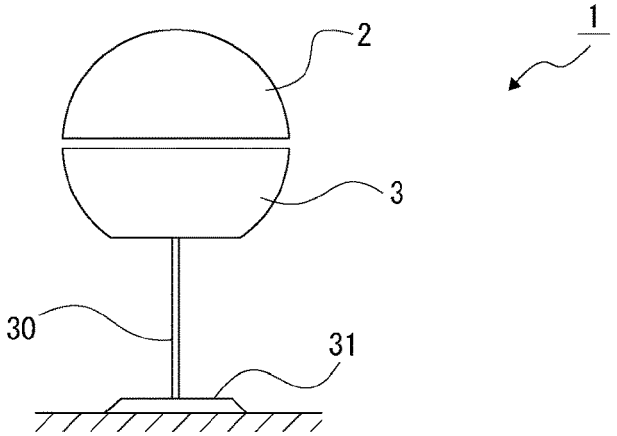
FIG. 13 is a side view showing an example of a stationary-type speaker device.

The speaker device 1 of a suspended-type has been described above as an example. However, the speaker device 1 may be of a stationary-type having a support leg 30 and a support base 31 (see FIG. 13). In a case where the speaker device 1 is of a stationary-type, the shape of the vibrators is not limited to a substantially hemispherical shape but may be determined to be any given shape as in the above cases.

The example of the speaker device 1 including two vibrators 2 and 3 has been described above. However, the speaker device 1 may include any given number of the vibrators, and therefore may have a configuration in which at least three vibrators are connected to the spring holder.

The example of providing three actuators 5 has been described above. However, the number of the actuators 5 is also determined to be any given number. The actuators 5, 5, 5 may not be spaced at equal intervals in the circumferential direction, and the locations of the actuators 5, may be determined to be any given locations.

<Present Technology>

The present technology may provide the following configurations.

(1)

A speaker device including:

an actuator that operates according to a driving signal;

a spring holder having a coupling portion to which the actuator is coupled, the spring holder at least being partially elastically deformable; and a plurality of vibrators connected together via the spring holder, the vibrators vibrating according to an operation of the actuator.

(2)

The speaker device according to (1), in which the actuator has a vibrating element that expands and contracts according to a driving signal, and the plurality of vibrators are pressed to the vibrating element as the vibrators are each in a state of being urged by the spring holder in a predetermined direction.

(3)

The speaker device according to (2), in which the vibrators are provided as two vibrators, and the two vibrators are located opposite to each other across the vibrating element and are put in a state of being in contact respectively with both ends of the vibrating element in a direction of its expansion and contraction.

(4)

The speaker device according to (3), in which the two vibrators are positioned such that their respective end faces are counter to each other and a cushion is placed between the end faces.

(5)

The speaker device according to any one of (1) to (4), in which the vibrators each have a cylindrical, conical, or substantially hemispherical shape, and a plurality of the actuators are spaced in a circumferential direction of the vibrators.

(6)

The speaker device according to (5), in which the plurality of actuators are spaced at equal intervals.

(7)

The speaker device according to any one of (1) to (4), in which the vibrators each have a cylindrical, conical, or substantially hemispherical shape, the plurality of actuators are spaced in a circumferential direction of the vibrators, a plurality of the coupling portions are spaced in the circumferential direction of the vibrators, and the plurality of actuators and the plurality of the coupling portions are arranged at equal intervals.

(8)

The speaker device according to any one of (1) to (7), in which the vibrators are provided as two vibrators, the spring holder has an annular first holding portion and an annular second holding portion, the first and second holding portions connecting the two vibrators together, and the first holding portion is located inside the second holding portion.

(9)

The speaker device according to (8), in which the coupling portions are formed on the second holding portion.

(10)

The speaker device according to any one of (1) to (9), in which a placement space is formed inside the plurality of vibrators, and the spring holder and the actuators are placed in the placement space.

(11)

The speaker device according to (10), in which a structure unit having a control board that controls at least the actuators is provided, and the structure unit is placed in the placement space.

(12)

The speaker device according to (11), in which the structure unit has a speaker unit that outputs a sound different from a sound output on the basis of vibration of the vibrators.

(13)

The speaker device according to (11), in which a plurality of the control boards are provided, the structure unit has a speaker unit that outputs a sound different from a sound output on the basis of vibration of the vibrators, and the plurality of control boards are arranged along periphery of the speaker unit.

(14)

The speaker device according to any one of (10) to (13), in which a lighting unit is placed in the placement space.

REFERENCE SIGNS LIST

1 Speaker device
2 Vibrator
3 Vibrator
4 Spring holder
5 Actuator
6 Structure unit
9 Cushion
10 Placement space
12 First holding portion
13 Second holding portion
16 Vibrating element
21 Light source (lighting unit)
24 Speaker unit
25 Control board
2A Vibrator
3A Vibrator
2B Vibrator
3B Vibrator
2C Vibrator
3C Vibrator
2D Vibrator
3D Vibrator
2E Vibrator
3E Vibrator
2F Vibrator
3F Vibrator

What is claimed is:

1. A speaker device, comprising:

an actuator that operates according to a driving signal;

a spring holder having a coupling portion provided at a terminal portion of the spring holder to which the actuator is connected, the spring holder at least being partially elastically deformable; and a plurality of vibrators connected together via the coupling portion of the spring holder, the vibrators vibrating according to an operation of the actuator.

2. The speaker device according to claim 1, wherein the actuator has a vibrating element that expands and contracts according to a driving signal, and the plurality of vibrators are pressed to the vibrating element as the vibrators are each in a state of being urged by the spring holder in a predetermined direction.

3. The speaker device according to claim 2, wherein the vibrators are provided as two vibrators, and the two vibrators are located opposite to each other across the vibrating element and are put in a state of being in contact respectively with both ends of the vibrating element in a direction of its expansion and contraction.

4. The speaker device according to claim 3, wherein the two vibrators are positioned such that their respective end faces are counter to each other, and a cushion is placed between the end faces.

5. The speaker device according to claim 1, wherein the vibrators each have a cylindrical, conical, or substantially hemispherical shape, and a plurality of the actuators are spaced in a circumferential direction of the vibrators.

6. The speaker device according to claim 5, wherein the plurality of actuators are arranged at equal intervals.

7. The speaker device according to claim 1, wherein the vibrators each have a cylindrical, conical, or substantially hemispherical shape, the plurality of actuators are spaced in a circumferential direction of the vibrators, a plurality of the coupling portions are spaced in the circumferential direction of the vibrators, and the plurality of actuators and the plurality of the coupling portions are arranged at equal intervals.

8. The speaker device according to claim 1, wherein the vibrators are provided as two vibrators, the spring holder has an annular first holding portion and an annular second holding portion, the first and second holding portions connecting the two vibrators together, and the first holding portion is located inside the second holding portion.

9. The speaker device according to claim 8, wherein the coupling portions are formed on the second holding portion.

10. The speaker device according to claim 1, wherein a placement space is formed inside the plurality of vibrators, and the spring holder and the actuators are placed in the placement space.

11. The speaker device according to claim 10, wherein a structure unit having a control board that controls at least the actuators is provided, and the structure unit is placed in the placement space.

12. The speaker device according to claim 11, wherein the structure unit has a speaker unit that outputs a sound different from a sound output on the basis of vibration of the vibrators.

13. The speaker device according to claim 11, wherein a plurality of the control boards are provided, the structure unit has a speaker unit that outputs a sound different from a sound output on the basis of vibration of the vibrators, and the plurality of control boards are arranged along periphery of the speaker unit.

14. The speaker device according to claim 10, wherein a lighting unit is placed in the placement space.

* * * * *